US006925729B2

(12) United States Patent
Sullivan et al.

(10) Patent No.: US 6,925,729 B2
(45) Date of Patent: Aug. 9, 2005

(54) HAIR DRYER AND MOUNTING ASSEMBLY

(75) Inventors: Brian R. Sullivan, Richmond, VA (US); Roy B. Bates, Glen Allen, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 68 days.

(21) Appl. No.: 10/696,410

(22) Filed: Oct. 29, 2003

(65) Prior Publication Data

US 2005/0091864 A1 May 5, 2005

(51) Int. Cl.[7] ..... F26B 25/00
(52) U.S. Cl. ..... 34/97
(58) Field of Search ..... 34/58–667

(56) References Cited

U.S. PATENT DOCUMENTS

| | | | |
|---|---|---|---|
| D145,084 | S | 6/1946 | Hutt |
| 3,293,528 | A | 12/1966 | Rosen |
| 3,953,710 | A | 4/1976 | Dyer |
| 3,964,708 | A | 6/1976 | Reeves |
| D242,953 | S | 1/1977 | Bluestein |
| 4,493,975 | A | 1/1985 | Yamamoto |
| D280,851 | S | 10/1985 | Muller |
| 4,659,907 | A | 4/1987 | Andis |
| 4,701,595 | A | 10/1987 | Okutsu |
| 4,858,336 | A | 8/1989 | Varma |
| 4,904,847 | A | 2/1990 | Kosaka |
| 4,910,385 | A | 3/1990 | Shye-Long |
| 5,181,328 | A | 1/1993 | Bouverie |
| D372,189 | S | 7/1996 | Andis |
| 5,590,475 | A | 1/1997 | Andis |
| 5,857,263 | A | 1/1999 | Chan |
| D409,799 | S | 5/1999 | Prochaska |
| D415,854 | S | 10/1999 | Marcus |
| 6,026,590 | A | 2/2000 | Picozza |
| D427,726 | S | 7/2000 | Cruz |
| RE36,995 | E | 12/2000 | Andis |
| D435,938 | S | 1/2001 | Bushman |
| 6,314,236 | B1 | 11/2001 | Taylor |
| 2002/0043003 | A1 | 4/2002 | Cruz |

FOREIGN PATENT DOCUMENTS

| | | | |
|---|---|---|---|
| JP | 6-318789 | 11/1994 | |
| JP | 8-141294 | * 6/1996 | ..... D06F 75/10 |

OTHER PUBLICATIONS

American Hotel Register Company 1999/2000 Buying Guide; cover sheet and 3 additional sheets showing pp. 684-687.

* cited by examiner

*Primary Examiner*—Stephen Gravini
(74) *Attorney, Agent, or Firm*—Akin Gump Strauss Hauer & Feld, LLP

(57) ABSTRACT

A combination hair dryer and mounting assembly includes a hair dryer having a switch movable between an OFF position in which the hair dryer is not energized and an ON position in which the hair dryer is energized. A receptacle is configured for receiving the hair dryer therein when the switch is in the OFF position. The receptacle prevents insertion of the hair dryer therein when the switch is in the ON position.

12 Claims, 2 Drawing Sheets

HAIR DRYER AND MOUNTING ASSEMBLY

BACKGROUND OF THE INVENTION

Hair dryers having a pistol grip design are generally known in the art. Such hair dryers generally include one or more switches for turning the hair dryer ON and OFF, adjusting the speed of the hair dryer motor and/or adjusting the heat output by the hair dryer. These switches are generally positioned on the handle or grip portion of the hair dryer in a manner which is convenient for the user and which allows ease of moving the switch.

Receptacles, holders or other similar mounting assemblies which attach or mount to a wall or other generally planar surface for receiving and storing a hair dryer therein are also generally known in the art. For example, it is often desirable for the user to store a hair dryer in a wall-mounted receptacle when the hair dryer is not in use. Such mounting assemblies may take the form of a simple cradle for resting the hair dryer thereon, or may be a larger surface mounted unit which supplies and regulates power to the hair dryer in addition to providing a place for hair dryer storage. With both types of mounting assemblies, it is desirable to ensure that the hair dryer is not received and stored in the receptacle while the hair dryer is still ON. Thus, hair dryer mounting assemblies which are generally known in the art generally include a mechanism to turn the hair dryer off prior to or upon insertion into the mounting assembly. For example, in mounting assemblies where the switch for the hair dryer is located on the mounting assembly itself, the mounting assembly may include a switch or other mechanism such that the power to the hair dryer is automatically turned OFF when the hair dryer is inserted into the receptacle and ON when the hair dryer is removed for use. Similarly, in designs where the switch for the hair dryer is located on the grip or another portion of the hair dryer, the mounting assembly may be designed such that the mounting assembly causes the switch to move to an OFF position upon insertion of the hair dryer into the receptacle. In both of these types of designs, however, the hair dryer is still energized during or even after insertion into the mounting assembly. Thus, should the mechanism which is designed to de-energize the hair dryer fail, or should the user manually disable the above-described mechanism, the hair dryer would then be stored in the receptacle while still energized, leading to an unsafe and hazardous condition. Accordingly, there exists a need for a hair dryer which is ensured to be OFF or de-energized prior to insertion into the mounting assembly.

BRIEF SUMMARY OF THE INVENTION

Briefly stated, according to a first aspect of the present invention, a combination hair dryer and mounting assembly comprises a hair dryer having a switch which is movable between an OFF position in which the hair dryer is not energized and an ON position in which the hair dryer is energized. A receptacle is configured for receiving the hair dryer therein when the switch is in the OFF position. The receptacle prevents insertion of the hair dryer therein when the switch is in the ON position.

According to a second aspect of the present invention, a hair dryer assembly comprises a hair dryer having a grip which has first and second ends. A dryer head is attached to the second end of the grip. A switch is movable between an OFF position in which the hair dryer is not energized and an ON position in which the hair dryer is energized. A receptacle is configured for receiving the hair dryer therein. The receptacle has a channel which receives at least a portion of the grip when the switch is in the OFF position. The channel prevents insertion of the hair dryer into the receptacle when the switch is in the ON position.

According to a third aspect of the present invention, a hair dryer assembly comprises a hair dryer having a grip which has first and second ends. A dryer head is attached to the second end of the grip. A switch is movable between an OFF position in which the hair dryer is not energized, and an ON position in which the hair dryer is energized. A receptacle for receiving the hair dryer therein includes a channel configured to receive at least a portion of the grip. The channel includes a switch recess sized and shaped to complementarily receive at least a portion of the switch. A switch projection adjacent to the switch recess projects outwardly from the channel. The switch recess abuts the switch when the switch is in the ON position, thereby preventing insertion of the hair dryer into the receptacle when the switch is in the ON position.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
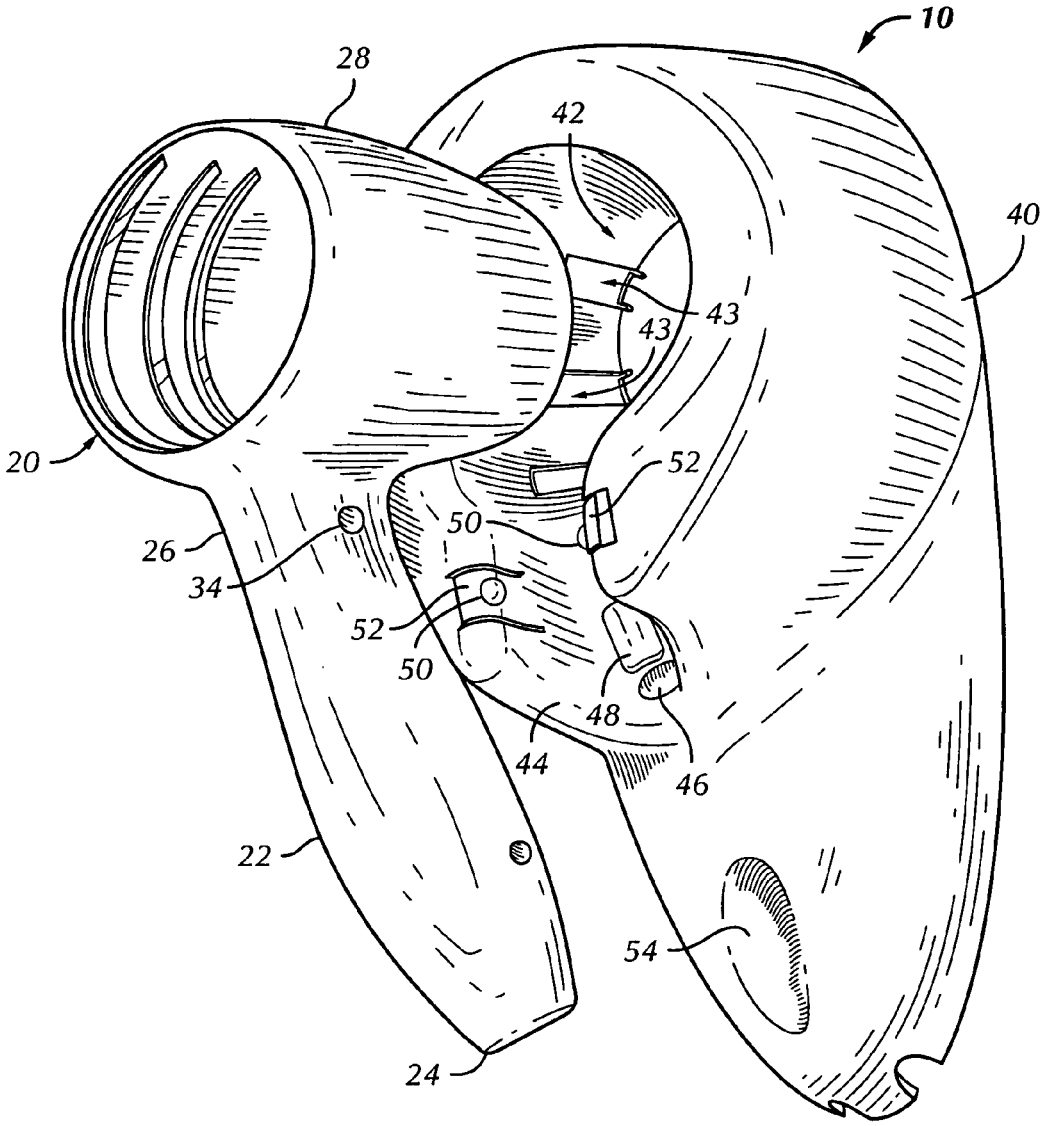
FIG. 1 is an exploded front perspective view of a hair dryer and mounting assembly according to a first preferred embodiment of the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the hair dryer and/or receptacle and designated parts thereof. The terminology includes the words above specifically mentioned, derivatives thereof and words of similar import.

Figure 2:
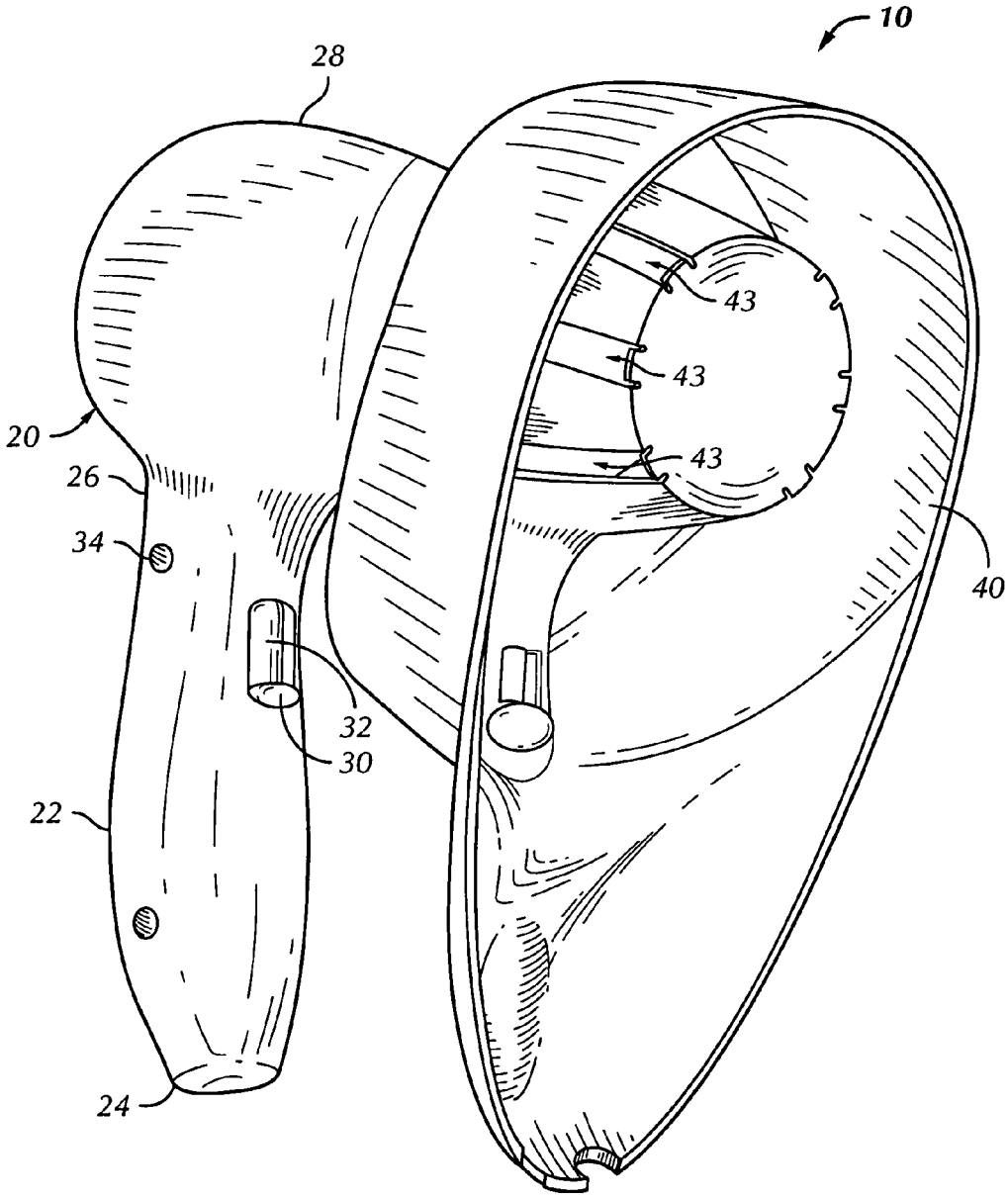
FIG. 2 is an exploded rear perspective view of the hair dryer and mounting assembly of FIG. 1.

Referring to the drawings in detail, wherein like numerals indicate like elements throughout, there is shown in FIGS. 1–2 a first preferred embodiment of a combination hair dryer and mounting assembly, generally designated 10, in accordance with the present invention. The assembly 10 includes a hair dryer 20 and a receptacle 40 for receiving and storing the hair dryer 20 therein. Hair dryers are generally known in the art, and a detailed description thereof is omitted here for convenience only, and should not be considered limiting. The hair dryer 20 may be any type of hair dryer which may be hand-held by a user. The hair dryer 20 may be powered through the receptacle 40 via a power cord (not shown) or alternatively, may be powered from an independent source (i.e., not directly connected to the receptacle 40).

The hair dryer 20 includes an elongate grip portion 22 shaped and sized such that a user may easily but securely hold the hair dryer 20 in one hand. The grip portion 22 has first and second ends 24 and 26, respectively. A generally cylindrical dryer head 28 is attached to the second end 26 and extends generally transversely to the grip portion 22, such that the hair dryer 20 has a conventional pistol-grip design. The grip portion 22 of the hair dryer 20 is preferably made from molded plastic, hardened rubber or a combination thereof to facilitate easy gripping by the user. However, the grip portion 22 and the hair dryer 20 may be made of any material which is generally known by those skilled in the art to be used with hair dryers.

Referring to FIG. 2, a switch 30 is located on the grip portion 22 between the first and second ends 24, 26. The switch 30 is movable between an OFF or down position (as shown in FIG. 2), and an ON or up position (not shown). When switch 30 is in the OFF position, the hair dryer is not energized and no power is supplied thereto. When the switch 30 is in the ON position, the hair dryer is energized in that at least the fan or heating element (not shown) is powered. The switch 30 projects generally radially at least some distance beyond the surface of the grip portion 22 so that the user may easily move the switch between the OFF and the ON positions with a thumb or finger. Those skilled in the art will recognize that the switch 30 may take any shape, so long as it may be actuated by the user, without departing from the spirit and scope of the present invention. The switch 30 slides between the ON and the OFF positions in a switch channel 32 which extends for a portion of the length of the grip portion 22. Those skilled in the art will recognize that the switch channel 32 may have a length which is substantially longer or shorter than that shown in FIG. 2. Additionally, the switch channel 32 may provide for multiple ON positions, as is customary with hair dryers generally known in the art. For example, in the ON position, the switch 30 may have a high-speed position and a low-speed position. Those skilled in the art will also recognize that the OFF position of the switch 30 need not be the lowermost position within the switch channel 32, as shown in FIG. 2. That is, the OFF position may be one in which the switch 30 is in the uppermost portion of the switch channel 32, or, if there are more than two switch positions, the OFF position of the switch 30 may be in an intermediate position within the switch channel 32.

The hair dryer 20 preferably includes one or more recesses 34 located on the grip portion 22 near the second end 26. The recesses 34 are preferably semi-spherical- or dimple-shaped to complementarily receive a portion of the mounting receptacle 40, as discussed in greater detail below. As will become evident from the discussion of the receptacle 40 below, those skilled in the art will recognize that the recesses 34 may take other shapes to mate with the corresponding portions of the receptacle 40, without departing from the spirit and scope of the present invention.

The receptacle 40 preferably mounts to a wall, table or other generally planar surface (not shown) in a location desirable for storing the hair dryer 20 when it is not in use. The receptacle 40 may be attached to the planar surface using screws, clips, double-sided tape or in any other manner generally understood by those of ordinary skill in the art. As noted above, the receptacle 40 may be directly connected to a power source (not shown) to supply power to the hair dryer 20.

The receptacle 40 includes a head receiving cavity 42 which is sized and shaped to complementarily receive at least a portion of the hair dryer head 28 therein. Preferably, the head receiving cavity 42 is deep enough to receive a substantial portion of the hair dryer head 28. However, those skilled in the art will recognize that the depth of the head receiving cavity 42 may vary depending on the depth of the channel 44, discussed in detail below, and thus may be different than the head receiving cavity 42 shown in FIGS. 1–2.

The circumferential perimeter of the head receiving cavity 42 preferably includes multiple air slats 43 which allow air to pass through the head receiving cavity 42 to the hair dryer head 28 to assist in cooling and venting the hair dryer 10 after it has been inserted into the receptacle 40. In an alternative embodiment, the head receiving cavity 42 may have no slats 43 or a different shape or number of slats 43 than is shown in FIG. 2 without departing from the spirit and scope of the present invention.

Referring to FIG. 1, the receptacle 40 further includes a generally U-shaped channel 44 for receiving at least a portion of the grip 22 between the first and second ends 24, 26 therein. Preferably, the receptacle 40, including the channel 44 and the head receiving cavity 42, is formed such that the grip 22 and the dryer head 28 of the hair dryer 10 may be simultaneously received by the channel 44 and the head receiving cavity 42, respectively, when the hair dryer 10 is inserted into the receptacle 40. That is, the channel 44 and the head receiving cavity 42 must be sized, shaped and spaced with respect to each other such that at least a portion of the hair dryer head 28 is complementarily received by the head receiving cavity 42 when the grip 22 is received by the channel 44.

Referring to FIGS. 1 and 2, the channel 44 includes a switch recess 46 which is shaped to complementarily receive a portion of the switch 30. The switch recess 46 is positioned in the trough of the channel 44 such that the switch recess 46 receives the switch 30 when the switch 30 is in the OFF position. The channel 44 further includes a switch projection 48 which projects outwardly from the channel 44 and which is adjacent the switch recess 46 in the channel 44. The switch projection 48 abuts the switch 30 if the switch 30 is in the ON position as the grip 22 is attempted to be inserted into the channel 44. Thus, the switch projection 48 prevents insertion of the grip 22 into the channel 44 when the switch 30 is in the ON position. Because of the location of the switch projection 48 in the channel 44 with respect to the switch recess 46, unless the switch 30 is completely in the OFF position, the switch 30 will abut the switch projection 48, thereby preventing full and complementary reception of the grip 22 into the channel 44. As shown in FIG. 1, the switch projection 48 is generally rectangular in shape. However, those of ordinary skill in the art will understand that the switch projection 48 may take other shapes and sizes, as long as it projects outwardly from the channel 44 and is positioned to abut the switch 30 when the switch 30 is in the ON position. Alternatively, the switch projection 48 may also run the entire length of the channel 44 with the exception of the switch recess 46.

As a result of the switch recess 46 and the switch projection 48 in the channel 44, the receptacle 40 completely receives the hair dryer 20 when the switch 30 is in the OFF position. Stated differently, the receptacle 40 prevents reception of the hair dryer 20 therein when the switch 30 is in the ON position. When the switch 30 is in the OFF position, the channel 44 receives at least a portion of the grip 22 between the first and second ends 24, 26 into the channel 44, such that the switch 30 aligns with and is received by the switch recess 46. When the channel 44 receives the grip 22 of the hair dryer 20, the head-receiving portion 42 also receives at least a portion of the dryer head 28 therein, such that a substantial portion of the hair dryer 20 is received by and mounted within the receptacle 40. When the switch 30 is in the ON position, even if the dryer head 28 is already partially received within the head receiving portion 42, inserting the grip 22 into the channel 44 will cause the switch 30 to abut the switch projection 48, thereby preventing insertion of the grip 22 into the channel 44 and the hair dryer 20 into the receptacle 40. Preferably, the hair dryer 20 completely disengages from the receptacle 40 since there is nothing to retain the hair dryer 20 in receptacle 40 if the grip 22 is not received in the channel 44. Thus, the structure of the assembly 10 prompts the user of the hair dryer 20 to manually move the switch 30 to the OFF position prior to inserting the hair dryer 20 into the receptacle 40. Furthermore, when the hair dryer 20 is received by the receptacle 40, because the switch 30 is also received by the switch recess 46, the switch 30 cannot be moved into an ON position since the switch recess 46 prevents movement of the switch 30 within the switch channel 32. Thus, when the hair dryer 20 is mounted in the receptacle 40, it cannot be energized since the switch 30 cannot move.

The receptacle 40 is preferably made of molded plastic, but may be made of other materials generally known in the art, such as hardened rubber or any other material generally known in the art which may be molded or fabricated in the manner described above to have a switch projection 48 and switch recess 46, without departing from the spirit and scope of the present invention.

The receptacle 40 preferably further includes a pair of opposing retention projections 50 positioned on the side walls of the channel 44. The retention projections 50 are preferably semispherical in shape such that they are complementarily received by the retention recesses 34 on each side of the grip 22 near the second end 26. However, the retention projections 50 may be any shape which corresponds to the shape of the retention recesses 34. The retention projections 50 are preferably mounted on flexible tabs 52 formed in the side walls of the channel 44. The flexible tabs 52 preferably flex inward and outward with respect to the channel 44 to allow the retention projections 50 to engage and disengage the retention recesses 34 on the grip 22. When the grip portion 22 is received into the channel 44, the retention projections 50 contact the grip portion 22 near the second end 26 such that the flexible tabs 52 flex outward until the retention projections 50 snap into the retention recesses 34. When the projections 50 are engaged with the recesses 34, the hair dryer 20 is releasably retained within the receptacle 40. When the user desires to remove the hair dryer 20 from the receptacle 40, the force of the user pulling on the grip 22 is sufficient to disengage the retention projections 50 from the retention recesses 34, since the flexible tabs 52 flex outwardly to allow the grip 22 to disengage from the channel 44. Those of ordinary skill in the art will recognize that the receptacle 40 may include only one retention projection 50 and flexible tab 52 or may include more than one pair thereof without departing from the spirit and scope of the present invention. Those skilled in the art will further recognize that the number of retention recesses 34 on the grip 22 need not necessarily correspond to the number of retention projections 50 in the channel 44, and vise versa. Additionally, those of ordinary skill in the art will recognize that the hair dryer 20 may be retained within the receptacle 40 in a manner other than the retention projections 50 engaging the retention recesses 34 without departing from the spirit and scope of the present invention. For example, the mounting assembly 10 may include one or more Velcro straps, hook and loop-type closures, clips or any similar retention elements generally known in the art to secure the grip 22 and/or the dryer head 28 within the receptacle 40.

The receptacle 40 preferably further includes a guide notch 54 located near the bottom of the receptacle 40. The guide notch 54 is preferably shaped to complementarily receive a portion of the grip 22 which faces the receptacle 40 upon insertion therein. Preferably, when the switch 30 is in the OFF position, and the hair dryer 20 is inserted and received into the receptacle 40, a front surface portion of the grip 22 at the second end 24 is received by the guide notch 54 for further alignment of the grip 22 with respect to the channel 44 and the receptacle 40. Those of ordinary skill in the art will recognize that the shape, location and number of guide notches 54 on the receptacle 40 may vary without departing from the spirit and scope of the present invention.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A combination hair dryer and mounting assembly comprising:

a hair dryer having a switch moveable between an OFF position in which the hair dryer is not energized and an ON position in which the hair dryer is energized; and a mounting cradle configured for receiving the hair dryer therein when the switch is in the OFF position, the mounting cradle preventing insertion of the hair dryer therein when the switch is in the ON position, the mounting cradle being separate and completely detachable from the hair dryer.

2. The hair dryer of claim 1 wherein the mounting cradle includes a switch recess shaped to receive at least a portion of the switch when the switch is in the OFF position.

3. The hair dryer of claim 1 wherein the mounting cradle includes a switch projection which projects outwardly from a surface of the mounting cradle and which prevents insertion of the hair dryer into the mounting cradle when the switch is in the ON position.

4. The hair dryer of claim 1 wherein the mounting cradle includes at least one projection which engages at least one complementary shaped recess on the hair dryer, the at least one projection helping to secure the hair dryer in the mounting cradle when the hair dryer is received in the mounting cradle.

5. The hair dryer of claim 4 wherein the at least one projection is generally semi-spherical in shape.

6. A hair dryer assembly comprising:

a hair dryer having a grip, the grip having first and second ends;

a dryer head attached to the second end of the grip;

a switch moveable between an OFF position in which the hair dryer is not energized and an ON position in which the hair dryer is energized; and a receptacle configured for receiving the hair dryer therein, the receptacle being separate and completely detachable from the hair dryer and having a channel which receives at least a portion of the grip when the switch is in the OFF position, the channel preventing insertion of the hair dryer into the receptacle when the switch is in the ON position.

7. The hair dryer of claim 6 wherein the channel includes a switch recess shaped to complementarily receive at least a portion of the switch when the switch is in the OFF position.

8. The hair dryer of claim 6 wherein the channel includes a switch projection which projects outwardly from the channel and which prevents insertion of the grip into the channel when the switch is in the ON position.

9. The hair dryer of claim 6 wherein the channel includes at least one projection which engages at least one complementary shaped recess on the grip, the at least one projection helping to secure the hair dryer in the receptacle when the grip is received in the channel.

10. The hair dryer of claim 9 wherein the at least one projection is generally semi-spherical in shape.

11. The hair dryer of claim 6 wherein the receptacle further comprises a cavity which receives the dryer head therein when the grip is received in the channel.

12. A hair dryer assembly comprising:

a hair dryer having a grip, the grip having first and second ends;

a dryer head attached to the second end of the grip;

a switch moveable between an OFF position in which the hair dryer is not energized and an ON position in which the hair dryer is energized; and a receptacle for receiving the hair dryer therein, the receptacle being separate and completely detachable from the hair dryer and having a channel configured to receive at least a portion of the grip, the channel further comprising:

a switch recess sized and shaped to complementarily receive at least a portion of the switch; and a switch projection adjacent to the switch recess and projecting outwardly from the channel, wherein the switch projection abuts the switch when the switch is in the ON position, thereby preventing insertion of the hair dryer into the receptacle when the switch is in the ON position.

* * * * *